United States Patent [19]

Keller

[11] 4,298,088

[45] Nov. 3, 1981

[54] DIFFUSER RESONANCES

[75] Inventor: Jakob Keller, Fislisbach, Switzerland

[73] Assignee: BBC Brown, Boveri & Company, Limited, Baden, Switzerland

[21] Appl. No.: 46,939

[22] Filed: Jun. 8, 1979

[30] Foreign Application Priority Data

Jun. 8, 1978 [CH] Switzerland ..... 6272/78

[51] Int. Cl.[3] ..... F01N 1/00

[52] U.S. Cl. ..... 181/211; 181/224; 251/118; 415/219 A

[58] Field of Search ..... 181/211, 212, 213, 224, 181/229, 230, 237, 247, 248, 254, 217, 175; 138/39, 40, 44; 415/119, 219 A, DIG. 1, 219 B, 219 C; 239/601, 602; 251/118

[56] References Cited

U.S. PATENT DOCUMENTS

| | | | |
|---|---|---|---|
| 2,795,931 | 6/1957 | Foll | 138/44 |
| 2,873,142 | 2/1959 | Zetterstrom | 239/601 |
| 2,882,991 | 4/1959 | Killian | 181/213 |
| 2,956,400 | 10/1960 | Ferri | 239/602 |
| 2,987,136 | 6/1961 | Lilley et al. | 181/217 |
| 3,289,921 | 12/1966 | Soo | 415/219 A |
| 3,658,437 | 4/1972 | Soo | 415/219 A |
| 3,733,902 | 5/1973 | Halmi | 138/44 |
| 3,733,903 | 5/1973 | Halmi | 138/44 |
| 3,902,601 | 9/1975 | Townley | 138/39 |
| 3,910,715 | 10/1975 | Yedidiah | 138/39 |
| 3,968,931 | 7/1976 | Smith | 239/601 |
| 4,098,073 | 7/1978 | Adkins et al. | 138/39 |

*Primary Examiner*—George H. Miller, Jr.
*Assistant Examiner*—Benjamin R. Fuller
*Attorney, Agent, or Firm*—Burns, Doane, Swecker & Mathis

[57] ABSTRACT

For suppression of flow-driven resonances, a cross section modification is undertaken at the outlet of a diffuser. The length of the cross section modification stands in a specified relationship to the sonic wave to be suppressed.

9 Claims, 8 Drawing Figures

DIFFUSER RESONANCES

BACKGROUND OF THE INVENTION

The invention concerns a device for suppressing flow-driven resonances in a diffuser.

It is generally well known that, for example in valve construction, flow-driven acoustic resonances appear in the connector to the restrictor when installing a diffuser. For the suppression of these very disturbing effects, different variations of restrictor geometry were tested. In this way, it was, for example, determined that bulb-shaped valve disks featured an unfavourable behavior with respect to the above-mentioned acoustic effects.

The control of the undesired vibration effects by measures taken at the restrictor features various disadvantages. For one thing, in many cases, the instability can thereby not be suppressed. For another thing, the optimum configurations desired for reasons of stability are not possible for reasons of flow losses or for reasons of mechanical stability.

It is known that the diffuser essentially encourages the appearance of a vibration and further that sonic waves run from the restrictor to the diffuser outlet and are there reflected. At this point flow energy can be removed whereby the resonances are induced. Accordingly, it is a primary object of the present invention to prevent the appearance of flow-driven acoustic resonances and at the same time to avoid additional flow losses.

According to the invention, the primary object is achieved in that a cross section modification is provided at the diffuser outlet in order to modify the acoustic impedance.

The resonance cycle in the diffuser is interrupted in the critical frequency range by an appropriate impedance modification of this type.

Since diffusers in the various flow turbines and devices customarily terminate either in an annular chamber or pass over into a continuous pipeline, the cross section modification can be an expansion, a contraction or a deflection at the diffuser outlet which is attached either symmetrically or asymmetrically at the outer circumference or in the case of ring or hub diffusers at the outer and/or at the inner circumference.

Since the diffusers are designed owing to flow-technical reasons to be as steady as possible, almost uniform surface expansion takes place along the diffuser, the modification of acoustic impedance at the diffuser outlet can be achieved in a specified frequency range of the sonic wave such that the cross section modification at the diffuser outlet essentially occurs rather quickly, i.e., on a section which is comparable with the wavelength of the sonic wave to be suppressed.

The advantage of the invention is more particularly to be seen in that the measure to be carried out can be controlled very well. Thus, it is possible for the minimum impedance modification required for a given diffuser inlet to be accurately specified. It is basically possible thereby for any vibration to be modified for whose appearance the diffuser is authoritatively responsible. A further advantage can be seen in the fact that no intervention has to be made in the more critical flow restrictor part in front of the diffuser inlet.

BRIEF DESCRIPTION OF THE DRAWINGS

Forms of construction of the invention are shown diagrammatically in the drawing wherein.

DETAILED DESCRIPTION OF THE PREFERED EMBODIMENTS

Figure 1:
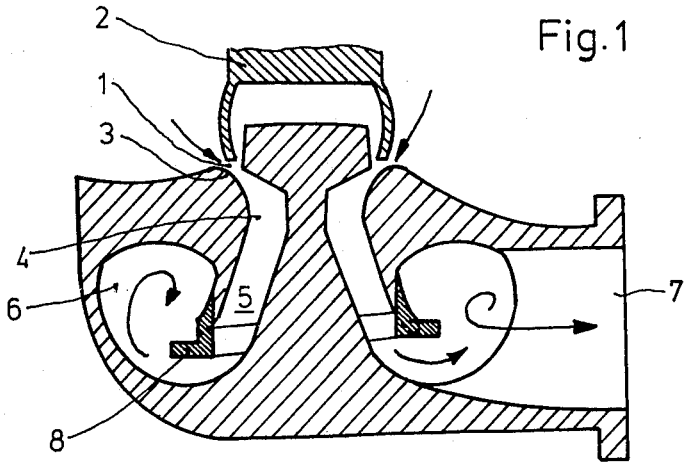
FIG. 1 is a cross sectional view of the center and outlet portion of a valve conventional in flow turbine construction having a diffuser according to the present invention.
Figure 7:
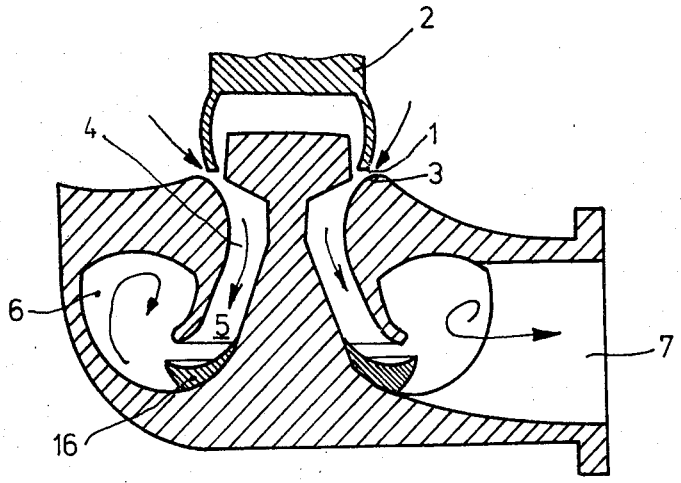

FIGS. 1 and 7 show only the parts of the valve which are necessary for understanding the invention. The same parts are always provided with the same reference numbers. The flow direction of the working medium is designated by arrows. The working medium flows into the ring diffuser 4 through flow restrictor 1 between valve disk 2 and valve seat 3. From diffuser outlet 5, it passes through annular chamber 6 to valve outlet 7.

According to the invention, at diffuser outlet 5 a cross section modification is undertaken, which in the case shown, consists of a simple L flange 8 which is arranged such that the cross section surface initially has a contraction and subsequently experiences an expansion.

Further, it can be seen that the angle-shaped flange is attached unsymmetrically, i.e., with a variation transverse to the flow direction. The modification runs vertically with respect to the flow direction varying over the circumference of the diffuser outlet. This thereby causes the travel time of the critical sonic waves from the diffuser outlet to the diffuser inlet and back to vary in length. This arrangement additionally has the effect that a destructive interference prevents the formation of a critical wave field.

Figure 2A:
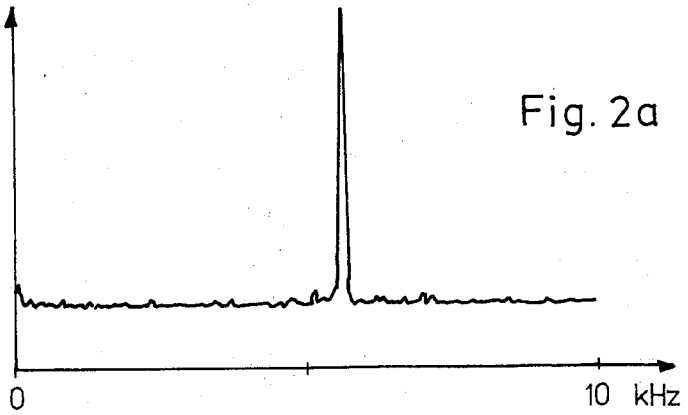
FIGS. 2*a* and 2*b* are diagrams of spectrally resolved pressure measurements.
Figure 2B:
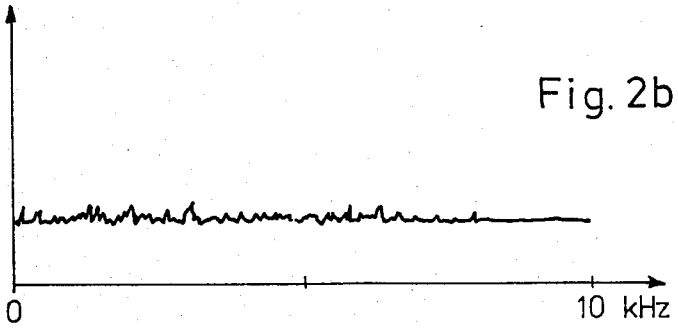

FIGS. 2*a* and 2*b* show the result of a spectrally resolved pressure measurement in the diffuser according to FIG. 1. FIG. 2*a* shows the pressure measurement in the ringless diffuser whereas FIG. 2*b* shows the pressure measurement with the annular arrangement according to the invention.

The frequency is plotted on the abscissa of the diagrams with the vibration amplitude plotted on the ordinate. In the case of the vibration amplitude, no statement of absolute values is made here with since these values are a function of all too numerous parameters and there is no validity to the values without knowledge of the parameters. As reference, it can be stated that the spectrum in FIG. 2*b*, in the displayed order of magnitude, corresponds to a conventional noise. A diffuser vibration is not to be obtained in this case.

On the other hand, the pressure measurement in the case of the ringless diffuser shows an accentuated cavity vibration. The amplitude value is less determinative than the energy content of this vibration which is expressed as the surface integral of the vibration.

Further, it could be demonstrated with this measurement that the modification of the acoustic impedance by the arrangement of the ring had no effect on the flow losses. FIGS. 3, 4, 5 and 6 show schematically the various principles of the possible cross section modifications.

The restrictor system is always designated by 10 and the actual diffuser by 11 and 12 designates the diffuser outlet at which the intervention takes place.

Figure 3:
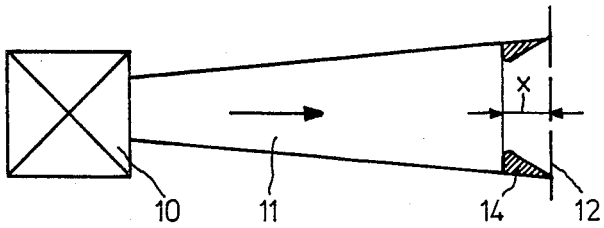
FIGS. 3 to 6 are schematic illustrations of cross sectionmodifications according to the invention and FIG. 7 is a cross sectional view of a variation of the valve according to FIG. 1.
Figure 4:
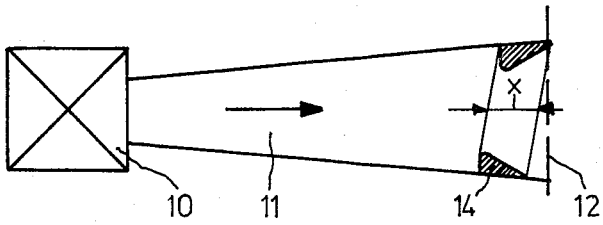

FIG. 3 deals with a channel contraction by arrangement of a symmetrical insert 14. In FIG. 4, the same insert is arranged asymmetrically whereby, as already mentioned, the travel time of the critical sonic wave from the diffuser outlet to the diffuser inlet and back is variable over the circumference of the diffuser.

Figure 5:
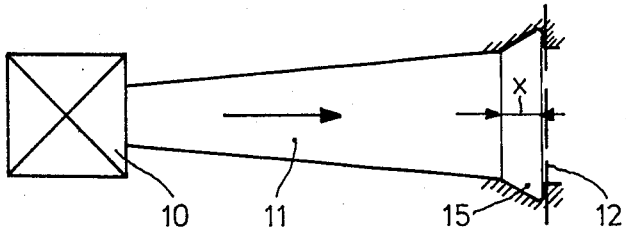
Figure 6:
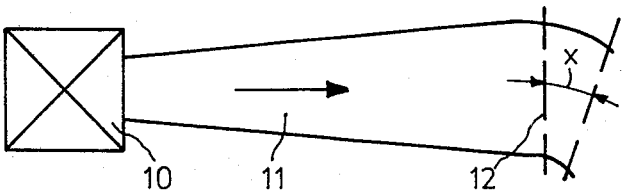

FIG. 5 shows a channel expansion by the arrangement of an annular tee slot 15 whereas, in FIG. 6, a flow deflection is undertaken following the diffuser outlet.

In all cases shown, the length of the cross section modification x stands in a certain relationship to the wavelength of the vibration to be suppressed.

FIG. 7 shows the arrangement of the cross section modification by flow deflection in a valve outlet housing according to FIG. 1. The deflection is caused by ring-shaped inserts 16 which are arranged on the inner circumference of the diffuser outlet.

Of course, the invention is not restricted to the shown and described designs. Thus, it is possible, for example, for the annular tee slot to be also asymmetrically designed according to FIG. 5 or the flow deflection asymmetrically designed according to FIG. 7. Further, the method involving contraction, expansion as well as deflection can be combined with each other without further details. Further, the device according to the invention is basically applicable for all diffusers encouraging the appearance of flow-driven acoustic resonances.

What is claimed is:

1. A diffuser structure comprising:

a flow path having an inlet and an outlet, the inlet having a cross-sectional flow area which is less than the cross-sectional flow area of the outlet;

a flow-driven resonance positioned immediately upstream of the flow path inlet;

means for modifying the acoustic impedance of the flow path, positioned at the flow path outlet but upstream thereof, including an abrupt change in the cross-sectional flow area of the flow path, and operable to suppress the flow-driven resonance.

2. The diffuser structure of claim 1 wherein the abrupt change of cross section of the flow path outlet is symmetrical about an axis of the flow path outlet.

3. The diffuser structure of claim 1 wherein the abrupt change of cross section of the flow path outlet is asymmetrical over a circumference of the flow path outlet.

4. The diffuser structure of claims 2 or 3 wherein the flow path outlet with an abrupt change of cross section has the form of a cavity extending over the circumference of the outlet.

5. The diffuser structure of claims 2 or 3 wherein the flow path outlet with an abrupt change of cross section provides a contraction of a cross sectional area of the outlet.

6. The diffuser structure of claim 5 wherein a member is provided at an outside circumference of the flow path outlet to provide said contraction.

7. The diffuser structure of claims 2 or 3 wherein the abrupt change of cross section of the flow path outlet is provided by a radial deflection of walls at the flow path outlet.

8. The diffuser structure of claim 7 wherein the radial deflection of the walls in the flow path outlet is provided by a ring-shaped insert arranged on an inside circumference of the outlet.

9. The diffuser structure of claim 7 wherein the flow path inlet is arranged within a valve, said valve having an annular ring chamber at an outlet of the valve.

* * * * *